United States Patent [19]

Donoho

[11] 4,341,573

[45] Jul. 27, 1982

[54] COMPOSITIONS FOR PULSATING FLARES

[75] Inventor: David W. Donoho, Baltimore, Md.

[73] Assignee: Pulsar Laboratories, Inc., Baltimore, Md.

[21] Appl. No.: 184,516

[22] Filed: Sep. 5, 1980

[51] Int. Cl.[3] ..... C06B 33/06

[52] U.S. Cl. ..... 149/42; 149/43; 149/71; 149/72

[58] Field of Search ..... 149/42, 43, 71, 82

[56] References Cited

U.S. PATENT DOCUMENTS

| | | |
|---|---|---|
| 323,662 | 8/1885 | Gerhard . |
| 590,231 | 9/1885 | Leusmann . |
| 2,130,068 | 5/1937 | Cimorosi . |
| 3,437,534 | 4/1969 | McEwan et al. . |
| 3,983,816 | 10/1976 | Cornia et al. . |
| 4,039,361 | 8/1977 | Ray et al. ..... 149/71 |

OTHER PUBLICATIONS

Manual of Explosives, Military Pyrotechnics, and Chemical Warfare Agents; 1943; Jules Bebie; p. 19; Aluminum Flares.

*Primary Examiner*—Stephen J. Lechert, Jr.
*Attorney, Agent, or Firm*—Dowell & Dowell

[57] ABSTRACT

Pyrotechnic compositions in which sulfur is utilized to regulate or control the ignition or detonation of potassium nitrate and aluminum in compositions which may be used as emergency, signal or display type flares and which are characterized by exhibiting a predetermined or timed pulsating illuminary effect.

8 Claims, 1 Drawing Figure

COMPOSITIONS FOR PULSATING FLARES

BACKGROUND OF THE INVENTION

Field of the Invention

This invention is directed generally to pyrotechnics and particularly to compositions for use in emergency, signal or display type flares which compositions are characterized by intermittent pulsating or flashing illumination when ignited.

SUMMARY OF THE INVENTION

The present invention is embodied in a composition of sulfur, potassium nitrate and aluminum which are blended together with or without the aid of various binding agents such as nitrocellulose varnish to produce pyrotechnic compositions which, when ignited, exhibit brilliant flashes of light at generally regularly sequenced intervals. It is known that when sulfur, potassium nitrate and aluminum are blended together in predetermined proportions, they form an explosive mixture. In the present invention, an excessive amount of sulphur is used, so as to suppress the instantaneous combustion of the potassium nitrate and aluminum when the compositions are ignited. After ignition, the excess amounts of sulfur will burn giving little or no light, however, a residue of potassium nitrate and aluminum powder remains with a portion of the sulfur which has not been consumed. When the excess sulphur has been consumed so that the materials substantially reach the predetermined proportions, residue is heated by the burning sulfur and thus reaches a critical temperature and detonates producing a brilliant flash of light. Thereafter, the excess sulfur in another position of the composition burns off causing a second ignition of residual material. The interval between such detonations of the potassium nitrate and aluminum residue may be selectively varied by increasing or decreasing the amount or percentage of sulfur in the pyrotechnic compositions.

It is an object of this invention to provide pyrotechnic compositions which, when ignited, burn in such a manner as to produce a series of intermittent detonations to thereby create a sequence of flashes or light pulsations.

It is another object of this invention to provide pyrotechnic compositions which may be used in powdered or molded form and which are not instantaneously detonated or consumed when ignited but which burn in such a manner as to produce a series of detonations and thereby create a pulsed or "strobe-light" effect.

It is another object of this invention to provide pulsating pyrotechnic compositions wherein the pulsation rate or period between flash detonations of portions of the composition may be varied or timed so as to be periodic in intervals from less than one second to more than twenty seconds, and in some instances, in intervals of a minute or more.

It is also an object of this invention to provide pyrotechnic flare compositions which may be blended with various adhesives and thereafter formed about a support rod or wire so as to produce a hand-held signal, emergency, or firework display type flare which emits a series of pulsed light.

DESCRIPTION OF THE PREFERRED EMBODIMENTS

Figure 1:
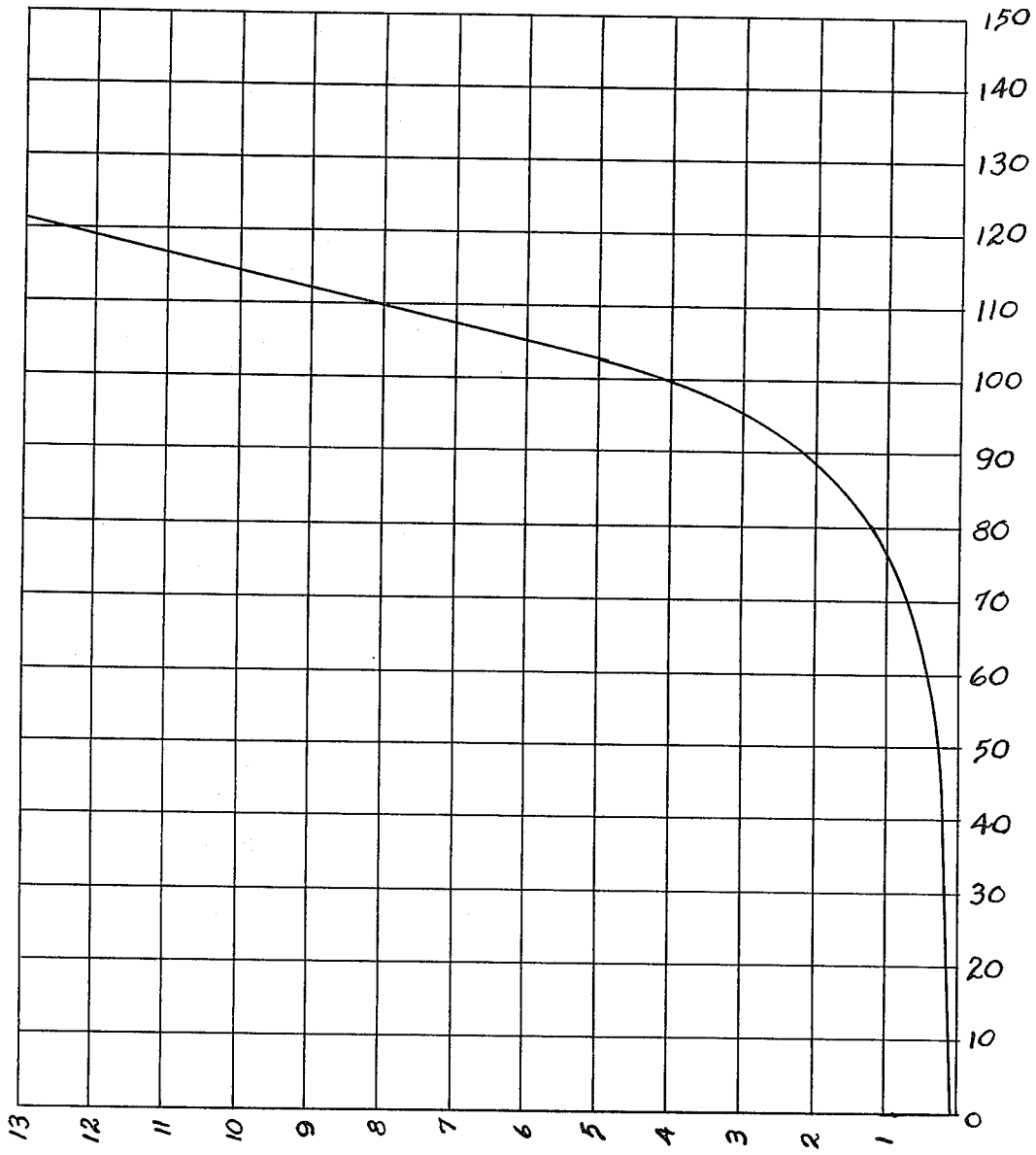
FIG. 1 is a graph showing the intervals between composition detonations or pulses in seconds, as a function of the varying amounts of sulfur in the composition.

The compositions of this invention may be used to provide pyrotechnic displays which are characterized by pulsations of light which crete a "strobe-like" lighting display. The compositions also may be used to create warning or signal-type flare devices or fireworks or other pyrotechnic displays and may be used in numerous physical forms as will be discussed hereinafter.

The pyrotechnic compositions include mixtures of potassium nitrate and aluminum which are blended in various proportions with particulate sulfur. Due to the combustion characteristics of these three primary chemical ingredients or compounds, the sulfur is used to selectively control the ignition or combustion of the aluminum and potassium nitrate. More particularly, it has been determined that if a sufficient amount of sulfur is present in compositions containing aluminum and potassium nitrate, that the excess sulfur will burn leaving a deposit or residue of aluminum and potassium nitrate which residue will combust when the excess amounts of sulfur have been consumed and the ingredients reach a substantially predetermined proportion. In this manner, the sulfur functions as an integral fuse. That is, although the sulfur is uniformily blended in the compositions, the excess amounts of sulfur, at various portions within a product formed of such compositions, will burn or be consumed before the remaining mixture which include the aluminum and potassium nitrate will detonate. After each detonation of a portion of the compositions, the sulfur in a contiguous area will continue to burn until the excess amount of sulfur in that area is consumed after which the remaining sulfur and aluminum and potassium nitrate residue will ignite causing another miniature explosion. The number of such detonations will depend upon various factors including the amount of composition present, the exposed surface area of the combustible product, the density of the pyrotechnic composition in use, the type of vehicle used as a support structure for the pyrotechnic composition and the ambient atmospheric conditions.

After numerous experiments with various mixtures of the primary chemical ingredients, it has been determined that the sequence of intervals between the detonations of residual aluminum and potassium nitrate can be regulated between periods of less than one second to more than twenty seconds depending primarily upon the amount of sulfur present in the composition. However, the rate of combustion will be affected by other factors including the ambient conditions such as temperature and humidity, and the uniformity and density of the compositions in use.

Further, the compositions according to this invention may be used in a number of physical forms and still exhibit the pulsed illumination caused by the sequenced detonation of portions of the composition. The compositions may be used in powdered form or compressed into tablets using suitable binder materials. Alternatively, they may be blended with adhesives and coated on wood, paper, or metal surfaces. In each form, the aluminum and potassium nitrate ignite in a sequenced manner to create a pulsed lighting display.

The following examples are illustrative to the pyrotechnic compositions formulated in conjunction with the above disclosed concept.

EXAMPLE 1

Seventy-five (75) parts by weight of sulfur powder were mixed with twenty-five (25) parts potassium nitrate and fifteen (15) parts aluminum powder. After thoroughly blending the mixture, the composition was placed into a small glass tray and formed into a line approximately an inch long and one-eighth inch wide. One end of the line was ignited and the composition began to burn with little or no light being detected. However, after several seconds, a portion of the material detonated causing a brilliant flash of light. Several moments later, a second flash was noted and subsequently other flashes occurring at substantially equally spaced intervals were noted as the composition was consumed from one end to the other along the inch or so of composition deposited on the glass surface.

EXAMPLE 2

The composition of Example 1 was mixed or blended in a vat after which a nitrocellulose varnish was added to act as a binder. After the mixture was thoroughly blended, a small diameter elongated wooden stick or rod was dipped into the mixture, and then withdrawn and allowed to dry. The resultant pyrotechnic device closely resembled a traditional "sparkler" product. However, when the end of the device was lighted it did not exhibit the continuous sparkling type burn which is characteristic of a traditional sparkler, but rather the burn was characterized by recurrent flashes of light. The effect of the high intensity white light which characterized each pulse or detonation was more closely related to a strobe light than to a sparkler. As the composition burned along the rod, brilliant flashes of light were emitted at approximately one and one-half (1½) to two (2) second intervals.

EXAMPLE 3

Utilizing the same ratio between the aluminum powder and potassium nitrate as in Example 2 the following composition was tested. Approximately ninety (90) grains of sulfur was dry blended with twenty-five (25) grains of potassium nitrate and fifteen (15) grains of aluminum powder. As with the prior examples, a pyrotechnic device was made by dipping a rod into a mixture of the composition with a varnish adhesive added for binding purposes. This device was ignited and the pulsation or sequence of miniature explosions creating the intense light were judged to be at approximately two (2) second intervals.

EXAMPLE 4

One hundred (100) parts by weight of sulfur were blended with twenty-five (25) parts potassium nitrate and fifteen (15) parts aluminum. The composition was placed on a flare type vehicle as described in Example 2. Thereafter, the flare was ignited. The characteristic pulsation rate defined by the intermittent detonations and the residual material including aluminum and potassium nitrate was noted to be at approximately three (3) second intervals.

With reference to the graph of FIG. 1, as a result of a number of tests, the interval between detonations of the residue of aluminum and potassium nitrate (pulses in seconds) has been shown as a function of the amount by weight in grains of sulfur mixed in compositions having twenty-five (25) grains of potassium nitrate and fifteen (15) grains of powdered aluminum. From the graph, it is noted that when the sulfur is present in amounts in excess of approximately 130 grains, which is a ratio of approximately 13:4 by weight, that there is such an excess of sulfur present that the residue of aluminum and potassium nitrate tends not to detonate at regular intervals. It is believed that when an excess amount of sulfur is present, small portions of the aluminum and potassium nitrate are consumed along with the burning excess sulfur over a period of approximately one-half a minute. The amounts of residual potassium nitrate and aluminum remaining are not sufficient to support instantaneous combustion. In practice, it has been found that it is not practical to blend a composition which will have flash intervals exceeding approximately twenty (20) to thirty (30) seconds using the aluminum and potassium nitrate.

It should be emphasized that the data reflected on the graph of FIG. 1 represents approximate values and that deviations can be expected depending upon the density of the composition, the degree of uniform blending of the chemicals in the composition, the type of vehicle used to support the composition during combustions, the amount of compositions applied to or contained in the supporting vehicle and the atmospheric conditions at the time of ignition. The deviation in the values reflected in the graph may be as much as ten (10) to twenty (20) percent. However, it is apparent that the amount of sulfur in the compositions does effectively regulate or alter the rate at which the aluminum and potassium nitrate are consumed.

With further reference to the graph of FIG, 1, it can also be observed that, as the amount of sulfur in the pyrotechnic composition is decreased, the rate at which the residue of aluminum and potassium nitrate ignite is increased. Thus, when sulfur is present in amounts less than approximately 50 to 60 grains per 25 grains of potassium nitrate and 15 grains aluminum the ignitions of all the components occurs substantially instantaneously so that pulsation of light is not discernible.

In addition to the primary components of sulfur, potassium nitrate and aluminum powder, other chemicals may be added to vary the effect of a flare made from these compositions without altering the pulsating characteristics achieved by utilizing appropriate excess amount of sulfur.

EXAMPLE 5

In order to produce a flare having a red flame, three (3) parts by weight of sulfur were blended with one part of potassium nitrate, one-half (½) part powdered aluminum and two parts strontium nitrate ($SrNO_3$). After preparing a flare in accordance with the previous examples, the tip of the flare was ignited. The flare exhibited the pulsating light or sequential detonations previously described, however, the flashes were red as opposed to the white color characteristic of the composition without strontium nitrate.

EXAMPLE 6

One (1) part iron oxide was blended with four (4) parts of aluminum powder, two (2) parts potassium nitrate and twelve (12) parts sulfur. The resultant flame of a flare prepared similarly to Example 2 was generally white and the pulsation rate was noted to be at approximately one to two second intervals.

In addition to the above examples, tests were made in which the potassium nitrate of the primary compositions were replaced by other oxidizing agents including either potassium perchlorate, $KClO_4$, or strontium nitrate $SrNO_3$. It was noted that the overall effect on the resultant compositions was to increase the delay or time between pulses or detonations as well as to increase the intensity of the flashes of light. With the use of the strontium nitrate, it was found that the delay between sequential detonations of the residual portion of the composition could be extended to periods of a minute or more. As previously noted, the longest workable intervals or delays in detonation time for composition utilizing potassium nitrate was approximately twenty (20) to thirty (30) seconds.

From the foregoing, it is apparent that sulfur can be used with compositions containing powdered aluminum and either potassium perchlorate or strontium nitrate to blend pyrotechnic compositions which exhibit intense light flashes which can be sequentially controlled between intervals of less than one second to periods of a minute or more. On a comparative basis, the time between the sequential detonation of the compositions, following the burn off of the excess sulfur, is increased when strontium nitrate or potassium perchlorate is substituted for the potassium nitrate in the prior examples; however, each of the detonations is more violent and the light intensity greater.

I claim:

1. A pyrotechnic composition which is characterized by a series of intermittent detonations when ignited comprising sulfur, potassium nitrate and powdered aluminum wherein the range in ratio by weight of the sulfur to the total of the potassium nitrate and aluminum is between approximately 5:4 and 13:4.

2. The composition of claim 1 in which the range in ratio by weight of the potassium nitrate to the aluminum is between 5:3 and 1:2.

3. The composition of claim 1 having 75 percent sulfur by weight, 25 percent potassium nitrate and 15 percent powdered aluminum.

4. A pyrotechnic composition which is characterized by a series of intermittent detonations when ignited comprising sulfur, aluminum and an oxidizing agent selected for the group consisting of potassium nitrate, potassium perchlorate and strontium nitrate in which said sulfur is present in a ratio by weight with respect to the total of the aluminum and oxidizing agent between approximately 6:7 and 13:4.

5. The pyrotechnic composition of claim 4 in which the ratio by weight of the sulfur to the total of the aluminum and oxidizing agent is between approximately 5:4 and 13:4.

6. A pyrotechnic flare including carrier means, a pyrotechnic composition supported by said carrier means, said composition being uniformly blended including sulfur, powdered aluminum and an oxidizing agent selected from the group consisting of strontium nitrate, potassium nitrate and potassium perchlorate wherein said sulfur is present in an amount by weight greater than that of the combined weight of aluminum and oxidizing agent.

7. A flare characterized by exhibiting a series of intermittent flashes of light comprising a support means and a pyrotechnic compositions carried by said support means, said pyrotechnic composition including a mixture of aluminum, potassium nitrate and sulfur, said sulfur being initially present in an excess amount sufficient to prevent spontaneous combustion of said aluminum and potassium nitrate when said composition is initially ignited, said aluminum and potassium nitrate being consumable in a series of intermittent detonations which are controlled by the burning of the excess sulfur in the composition.

8. The flare of claim 7 wherein the range and ratio by weight of the sulfur to the total of the potassium nitrate and aluminum is between approximately 5:4 and 13:4.

* * * * *